US012490848B1

(12) United States Patent
Betancur

(10) Patent No.: US 12,490,848 B1
(45) Date of Patent: Dec. 9, 2025

(54) PILLOW ASSEMBLY

(71) Applicant: Alejandro Betancur, Boynton Beach, FL (US)

(72) Inventor: Alejandro Betancur, Boynton Beach, FL (US)

( * ) Notice: Subject to any disclaimer, the term of this patent is extended or adjusted under 35 U.S.C. 154(b) by 249 days.

(21) Appl. No.: 17/942,714

(22) Filed: Sep. 12, 2022

(51) Int. Cl.
*A47G 9/10* (2006.01)
*A42B 3/04* (2006.01)
*A45D 44/22* (2006.01)

(52) U.S. Cl.
CPC ..... *A47G 9/10* (2013.01); *A47G 9/1045* (2013.01); *A47G 9/109* (2013.01); *A42B 3/04* (2013.01); *A45D 44/22* (2013.01)

(58) Field of Classification Search
CPC ..... A47G 9/10; A47G 9/1009; A47G 2009/1018; A47G 9/1027; A47G 9/1036; A47G 9/1045; A47G 9/1054; A47G 9/1063; A47G 9/1072; A47G 9/1081; A47G 9/109; A47G 2009/003; A47G 2009/006; A47G 2200/106; A47G 9/007; A47C 7/383; A47C 27/086; A45D 44/22; A42B 3/00; A42B 1/006; A42B 1/046; A42B 1/045
See application file for complete search history.

(56) References Cited

U.S. PATENT DOCUMENTS 2,696,007 A 12/1954 Larkin et al.
3,087,166 A 4/1963 Howard
4,679,263 A 7/1987 Honer
4,745,637 A * 5/1988 Steele ..... A42B 3/00 2/421
4,887,319 A 12/1989 Daniels
4,951,337 A 8/1990 Hull
5,978,972 A 11/1999 Stewart et al.
6,088,836 A 7/2000 Cordova
6,427,253 B1 8/2002 Penny
6,625,820 B1 9/2003 Lampe
6,651,256 B1 * 11/2003 Swift ..... A47G 9/10 2/202
7,428,763 B2 9/2008 Hightower
7,761,933 B2 7/2010 Pham
9,381,106 B2 7/2016 Gilmer et al.
9,833,025 B2 * 12/2017 Knapp ..... A41D 1/00
D831,386 S 10/2018 Thorn
10,123,638 B2 11/2018 Thorn
10,945,545 B2 3/2021 Anderson
D923,363 S * 6/2021 Brandy ..... D6/601
(Continued)

*Primary Examiner* — Justin C Mikowski
*Assistant Examiner* — Deborah Talitha Gedeon
(74) *Attorney, Agent, or Firm* — ALBERT BORDAS, P.A.

(57) ABSTRACT

A pillow assembly having a pillow body, earflaps, bottom strap assembly, and a top strap assembly. The pillow body has a front panel, a rear panel, lateral panels, a top end, a rear panel bottom end, a front panel bottom end, and a cavity. The earflaps are attached to the pillow body. The bottom strap assembly have first and second straps having respective fastener pieces. The first and second straps are joined under a chin. The top strap assembly is attached to the top end. The top strap assembly has four straps having respective fastener and a crown support having four slots. The straps each extend from the top end toward the cavity. The pillow body is mounted onto the head of a user. The pillow body is adjusted on the head by the top strap assembly and the bottom strap assembly.

1 Claim, 5 Drawing Sheets

(56) References Cited

U.S. PATENT DOCUMENTS

| | | | | |
|---|---|---|---|---|
| 2012/0095538 | A1* | 4/2012 | Dow | A61F 7/02 607/109 |
| 2013/0046219 | A1 | 2/2013 | Mendez et al. | |
| 2015/0100007 | A1 | 4/2015 | Loring et al. | |
| 2016/0120253 | A1 | 5/2016 | Schenk | |
| 2020/0323689 | A1* | 10/2020 | Morshed | A47G 9/1081 |

* cited by examiner

PILLOW ASSEMBLY

BACKGROUND OF THE INVENTION

Field of the Invention

The present invention relates to pillows, and more particularly, to a pillow worn on the head of an individual.

Description of the Related Art

Applicant believes that one of the closest references corresponds to U.S. Pat. No. 6,625,820 B1 issued to Lampe on Sep. 30, 2003, for Protective headguard. However, it differs from the present invention because Lampe teaches a protective headguards comprising a front panel, a rear panel, and a means for releasably connecting the lateral ends of the front and rear panels. At least one and preferably both of the front and rear panels comprise layers of at least a shell, a shock absorbing liner and a comfort liner.

Applicant believes that another reference corresponds to U.S. Pat. No. 6,427,253 B1 issued to Penny on Aug. 6, 2002, for Protective headgear comprising a headband and a semi-rigid support to protect a back region of a user's head. However, it differs from the present invention because Penny teaches a protective headgear comprising a headband and two shield plates. In a back region, the headband and the shield plate extend down behind the user's ear towards a bottom region on a user's head. The shield plate has a bottom protective rim that is designed to cup underneath a user's skull to shield the base of the user's skull. In addition, both shield plates have a small gap between them so that they wrap around the user's head. Additional components can also be added to this headgear. For example, this headgear can also include a terry cloth in a front region to gather sweat or moisture from a user's forehead. In addition, two ear flaps can also be attached to the headgear to cover a user's ears. These earflaps are designed to keep the user warm in the winter. In addition, this headgear can be alternately opened and closed via a releasable fastener such as a hook and loop fastener.

Applicant believes that another reference corresponds to U.S. Pat. No. 6,651,256 B1 issued to Swift on Nov. 25, 2003, for Wearable pillow. However, it differs from the present invention because Swift teaches a pillow worn in the manner of a helmet and includes an inner layer of cotton type material, an outer layer and an intermediate layer of foam or the like. The pillow blocks noise from getting to the wearer and can block light as well. The pillow also includes a neck-supporting portion. A stretchable neck-encircling portion permits the pillow to be pulled over the wearer's head while holding the pillow snugly in place.

Applicant believes that another reference corresponds to U.S. Pat. No. 2,696,007 A issued to Larkin et al. on Dec. 7, 1954, for Sleeping Halo or cap. However, it differs from the present invention because Larkin et al. teach a combined sleep-cap and pillow adjustably secured to the head of a wearer.

Applicant believes that another reference corresponds to U.S. Pat. No. 5,978,972 A issued to Stewart, et al. on Nov. 9, 1999, for Helmet system including at least three accelerometers and mass memory and method for recording in real-time orthogonal acceleration data of a head. However, it differs from the present invention because Stewart, et al. teach a system designed to measure and record in real time data relating to translational and angular acceleration of an individual's head during normal sporting activity. One embodiment of the device includes at least three orthogonal accelerometers mounted within a sports helmet together with means for recording, in real-time, the data output from the accelerometers. The data is either recorded on a memory card or other mass memory means installed in the helmet or is transmitted to a nearby receiver for reception and storage on a computer's hard drive or other conventional mass storage device. The device provides real-time storage of translational and angular acceleration data over a length of time such that cumulative exposure effects and thus limits can be established for the individual's further or future participation in the sport. The data also allows detection of the precise motions of the head which precede the occurrence of a severe head injury.

Applicant believes that another reference corresponds to U.S. Pat. No. 6,088,836 A issued to Cordova on Jul. 18, 2000, for Audio/visual sensory inhibitor. However, it differs from the present invention because Cordova teaches a meditation and sleep enhancing device having a light occlusion portion attached to a head rest portion and a chin-strap extending therefrom. When in use by an individual, the sleep enhancing device acts both as a light and sound suppression device as well as providing a comfortable pillow and neck support. When not in use, the chin strap may be used as a handle to easily transport the device.

Applicant believes that another reference corresponds to U.S. Pat. No. 9,381,106 B2 issued to Gilmer, et al. on Jul. 5, 2016, for Cranial position orientation detection method and apparatus for pediatric patients. However, it differs from the present invention because Gilmer, et al. teach a force distribution apparatus and method. The apparatus includes a plurality of layers configured and oriented to be deployed on a subject in a manner that disperses forces and lowers peak pressures experienced by the subject when resting on a surface, which tends to minimize risks of deformation and local ischemia. An innovative combination of novel construction methods, material selections, and sensors produce an apparatus that possesses an inherent three-dimensional shape despite being built from essentially flat components, while also retaining an ability to effectively distribute forces and reduce pressures. Further embodiments of the disclosed apparatus are adapted to detect and monitor motion and position of the subject, providing retrospective or real-time data for caregivers.

Applicant believes that another reference corresponds to U.S. Pat. No. 3,087,166 A issued to Howard on Apr. 30, 1963, for Hockey Helmet. However, it differs from the present invention because Howard teaches a helmet, which has a front panel conformant to a wearer's forehead and including lateral temple over portion and a back panel.

Applicant believes that another reference corresponds to U.S. Pat. No. 7,761,933 B2 issued to Pham on Jul. 27, 2010, for Baby hat and method of manufacturing same. However, it differs from the present invention because Pham teaches hats for supporting and protecting a portion of a baby's head and methods of making same.

Applicant believes that another reference corresponds to U.S. Pat. No. 4,951,337 A issued to Hull on Aug. 28, 1990, for Mechanic's support pillow. However, it differs from the present invention because Hull teaches a pillow designed and adapted to cover the back portion of a user's head such as a mechanic or workman, said pillow being secured to user's head by means of an elastic or adjustable strap thereby freeing up the use of both of the user's hands when the user is moving about on his back beneath a vehicle or the like, with the filling of the pillow being removable to facilitate the cleaning or washing of the pillow cover and strap, and with the section of the pillow which lays adjacent to the user's head containing means to attach a cap to cover the user's head which cap may also be provided with a visor or the like to protect the eyes of the user.

Applicant believes that another reference corresponds to U.S. Pat. No. 7,428,763 B2 issued to Hightower on Sep. 30, 2008, for Universal, multipurpose pillow used for beauty and/or health purposes. However, it differs from the present invention because Hightower teaches a pillow used for eliminating any physical contact between a specific delicate skin area of a user body part, a support surface, and the pillow, thus completely eliminating any possible contact between the specific delicate skin area and any associated object. For example, the specific delicate skin area may be the face of the user, the users body part being their head and the support surface being a bed. The pillow is so structured as to be removably, adjustably, and comfortably worn and attached onto any part of the user body and may also be made from numerous materials of choice.

Applicant believes that another reference corresponds to U.S. Pat. No. 10,945,545 B2 issued to Anderson on Mar. 16, 2021, for Whole-head pillow. However, it differs from the present invention because Anderson teaches a pillow having a head portion having a head-shaped cavity sized in approximate proportions to receive a human head. The head portion has an inner surface, an outer surface, an open face, a left side, a left-side ear hole, a right side, a right-side ear hole, and an open bottom. There are a plurality of pads inside the head-shaped cavity that are selectively removable from the head-shaped cavity to accommodate a variety of head sizes and a washable liner covering the plurality of pads that is selectively removable from the pillow to accommodate laundering. The pillow has a neck portion extending from the open bottom and a circumferential pad on the outer surface of the head portion that is selectively removable to increase or decrease the size of the head portion.

Applicant believes that another reference corresponds to U.S. Pat. No. 4,887,319 A issued to Daniels on Dec. 19, 1989, for Unitary contiguous face and neck protector all weather cover for hard head gear. However, it differs from the present invention because Daniels teaches a weather protective unitary contiguous substantially flat face and neck cover for use with hard head gear. The cover has an outer layer of non-stretchable waterproof highly reflective nylon having a liner of thermally insulated material. The cover has a top bridge portion above the face of the wearer which terminates in side flaps. Waterproof elastic piping is secured about the free edge of the cover to seat tightly about the portions of the hard hat with which it is in contact as well as to seat tightly about the face and neck of the wearer to shut out weather elements such as wind, snow, rain and the like from contact with the wearer over the area covered by the unitary face and neck cover. The side flaps extending off the top bridge portion have flap securing means to maintain the flaps connected at their free ends beneath the chin of the wearer.

Applicant believes that another reference corresponds to U.S. Pat. No. 4,679,263 A issued to Honer on Jul. 14, 1987, for Whole-head pillow. However, it differs from the present invention because Honer teaches a pillow carried on a person's head to hold the head in a natural position. The pillow includes a back cushion held against the back of the head, and side cushions held against the sides of the head. The side cushions are hinged to the back cushion to hold the rear ends together, and straps are fixed to the front of the side cushions to hold the front ends together. A flap is fixed to the back cushion and extends over the top of the head and is fixed to the straps to prevent downward movement of the pillow. The back cushion may have an extension shaped to support the cervical region of the backbone in its natural shape.

Applicant believes that another reference corresponds to U.S. Pat. No. 10,123,638 B2 issued to Thorn on Nov. 13, 2018, for Pillow. However, it differs from the present invention because Thorn teaches a pillow having a substantially U-shaped body defining a recess adapted to house the neck of a user. The U-shaped body has a rear portion and first and second side portions that define a rear wall and first and second side walls of the recess and define a shoulder-contacting base and an upper surface. The pillow has a first inflatable headrest having a lower part housed in the recess adjacent the first side wall of the recess and a second inflatable headrest having a lower part housed in the recess adjacent the second side wall of the recess. The first and second inflatable headrests are each alterable between a first configuration wherein they are deflated and a second configuration wherein they are inflated such that respective upper parts of the headrests extend upwardly from the recess so as to cover respective ears of a user.

Applicant believes that another reference corresponds to U.S. Pat. No. D831,386 issued to Thorn on Oct. 23, 2018, for Glasgow. However, it differs from the present invention because Thorn teaches an ornamental design for a forehead pillow.

Applicant believes that another reference corresponds to U.S. Patent Application Publication No. 2013/0046219 A1 published on Feb. 21, 2013, to Mendez, et al. for neonatal cranial support bonnet. However, it differs from the present invention because Mendez, et al. teach a neonatal cranial support bonnet configured to prevent a premature child's head from deforming under the force of its own weight, because of underdeveloped cranial plates. The bonnet includes a thin cotton shell with contoured gel packs inside. The gel packs are configured to distribute weight around the skull and eliminate or reduce high-pressure points so as to maintain proper shape of the cranium. The bonnet is also configured to not interfere with development, and to not obstruct airways for breathing, so as to meet current Sudden Infant Death Syndrome prevention guidelines.

Applicant believes that another reference corresponds to U.S. Patent Application Publication No. 2015/0100007 A1 published on Apr. 9, 2015, to Loring, et al. for Force Distribution Method and Apparatus for Neonates at Risk of Cranial Modlding. However, it differs from the present invention because Loring, et al. teach a force distribution apparatus and method. Various embodiments of the disclosed apparatus include a plurality of layers configured and oriented to be deployed on a subject in a manner that disperses forces and lowers peak pressures experienced by the subject when resting on a surface, which tends to minimize risks of deformation and local ischemia. An innovative combination of novel construction methods and material selections produce an apparatus that possesses an inherent three-dimensional shape despite being built from essentially flat components, while also retaining an ability to effectively distribute forces and reduce pressures.

Applicant believes that another reference corresponds to U.S. Patent Application Publication No. 2016/0120253 A1 published on May 5, 2016 to Christopher Schenk. for Head Encircling Sensory Deprivation Pillow. However, it differs from the present invention because Schenk teaches a sleep-enhancing device comprising an elongated pillow that wraps around the eyes and ears of the user and is thick enough to enable the user to rest their head on a hard surface without any part of their face touching the hard surface.

Other patents describing the closest subject matter provide for a number of more or less complicated features that fail to solve the problem in an efficient and economical way. None of these patents suggest the novel features of the present invention.

SUMMARY OF THE INVENTION

The present invention is a pillow assembly comprising a pillow body having a front panel, a rear panel, lateral panels, and a top end. Further comprising earflaps attached to the pillow body, a bottom strap assembly, and a top strap assembly attached to the top end. Further comprising a rear panel bottom end and a front panel bottom end. The front panel, the rear panel, and the lateral panels define a cavity. The top end comprises a zipper.

The front panel, the rear panel, and the lateral panels form a single piece. The earflaps comprise first and second earflaps having first and second perimetral edges respectively. The first and second earflaps are attached to the first and second lateral panels respectively. The bottom strap assembly comprises first and second straps having respective fastener pieces. The first and second straps extend from a lower section of respective first and second earflap perimetral edges. A section of the first and second straps are further attached to the first and second lateral panels respectively. The first and second straps are joined under a chin by the fastener pieces. The fastener pieces adjust the first and second straps to fit around a head.

The top strap assembly comprises four straps having respective fasteners, and a crown support having four slots. The straps extend from the top end toward the cavity. The four straps are positioned on the top end separated approximately 90 degrees from each other. The slots are aligned with a respective one of the four straps, whereby each slot receives one of the four straps. The four straps engage with a corresponding slot, forming a loop secured by respective he fasteners. The four straps adjust a diameter of the cavity. The pillow body is worn by a user. The pillow body is adjusted on the head by the top strap assembly and the bottom strap assembly.

It is therefore one of the main objects of the present invention to provide a pillow assembly.

It is another object of this invention to provide a pillow assembly, which mounts onto the head of a user.

It is another object of this invention to provide a pillow assembly that is adjustable around the head of the user.

It is another object of this invention to provide a pillow that is volumetrically efficient for carrying, transporting, and storage.

It is another object of this invention to provide a pillow, which is of a durable and reliable construction.

It is yet another object of this invention to provide a pillow that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

Figure 1:
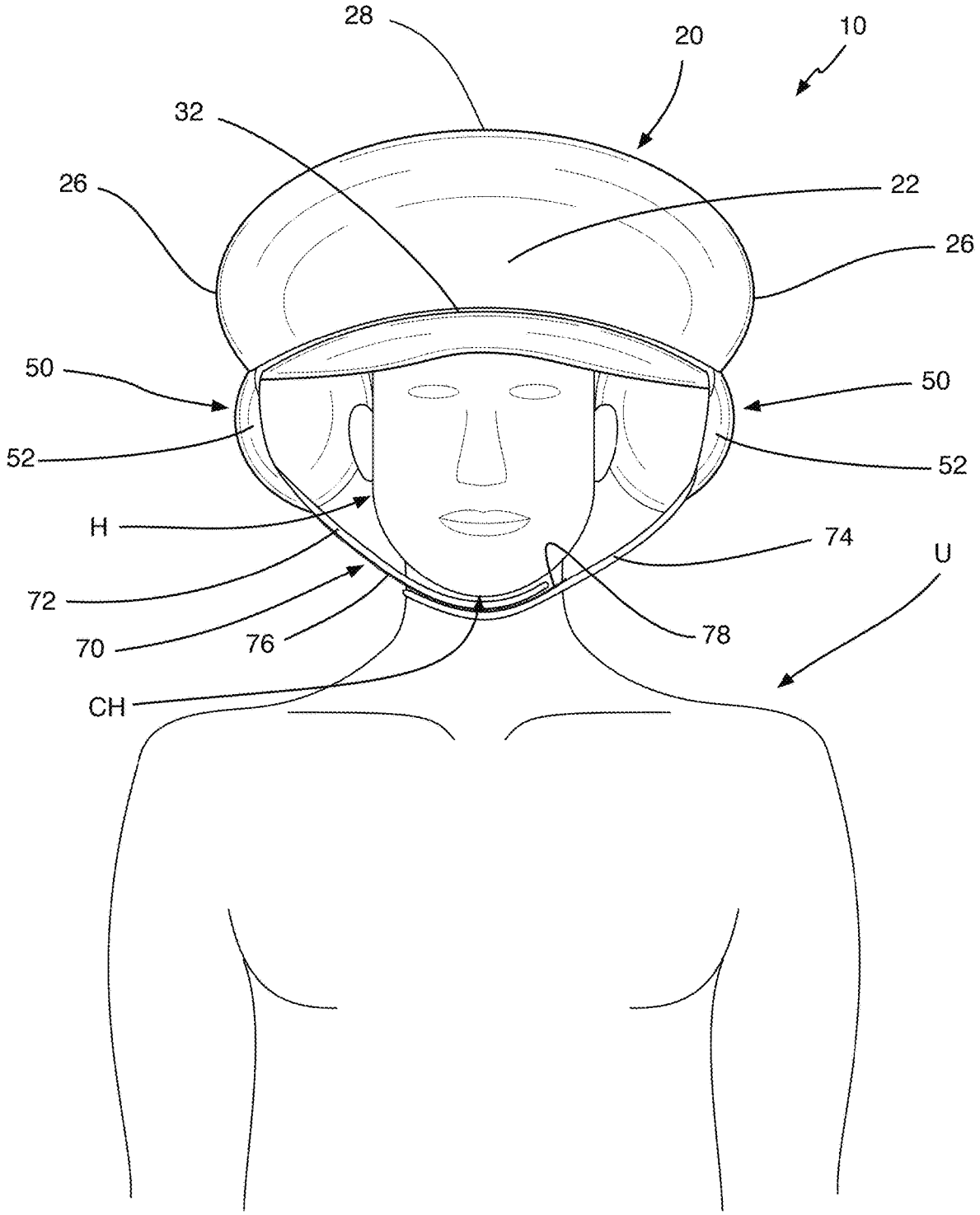
FIG. 1 is a front view of a person wearing the present invention.

Referring now to the drawings, the present invention is a pillow assembly, and is generally referred to with numeral 10. It can be observed that it basically includes pillow body 20, earflaps 50, bottom strap assembly 70, and top strap assembly 90.

Figure 2:
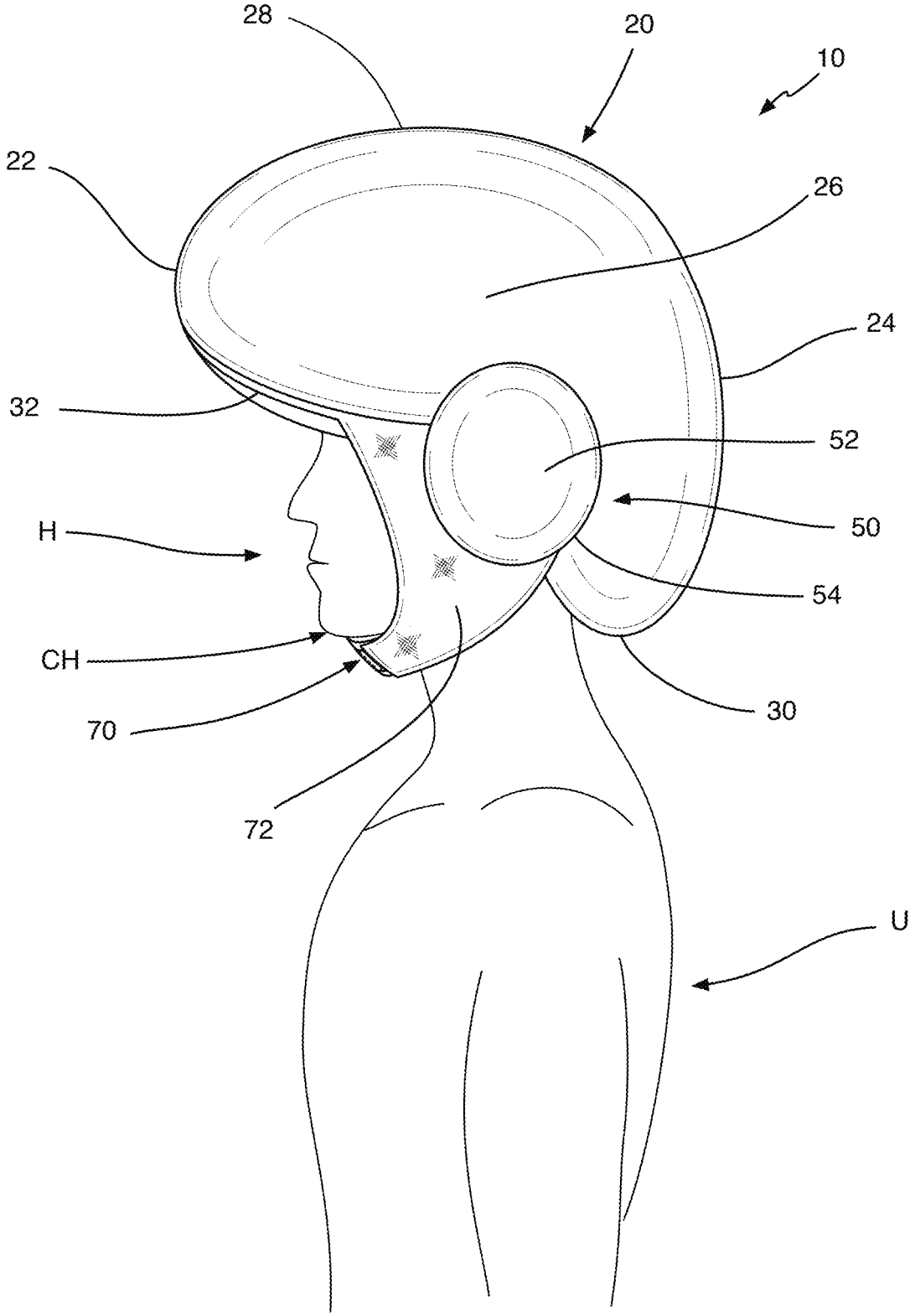
FIG. 2 is a side view of a person wearing the present invention.

As seen in FIGS. 1 and 2, pillow body 20 comprises front panel 22, rear panel 24, lateral panels 26, top end 28, rear panel bottom end 30, and front panel bottom end 32. Top end 28 comprises zipper 36, as seen in FIG. 4. Front panel 22, rear panel 24, and lateral panels 26 form a single piece. Pillow body 20 has cavity 34 seen in FIG. 3. More specifically front panel 22, rear panel 24, and lateral panels 26 define cavity 34. Earflaps 50 are attached to pillow body 20. Earflaps 50 comprise first and second earflaps 52, each having first and second perimetral edges 54 respectively. First and second earflaps 52 are attached to first and second lateral panels 26 respectively. Pillow body 20 is worn by a user U, whereby it is mounted onto head H of user U. Pillow body 20 is adjusted on head H by top strap assembly 90, seen in FIG. 4, and bottom strap assembly 70.

Figure 3:
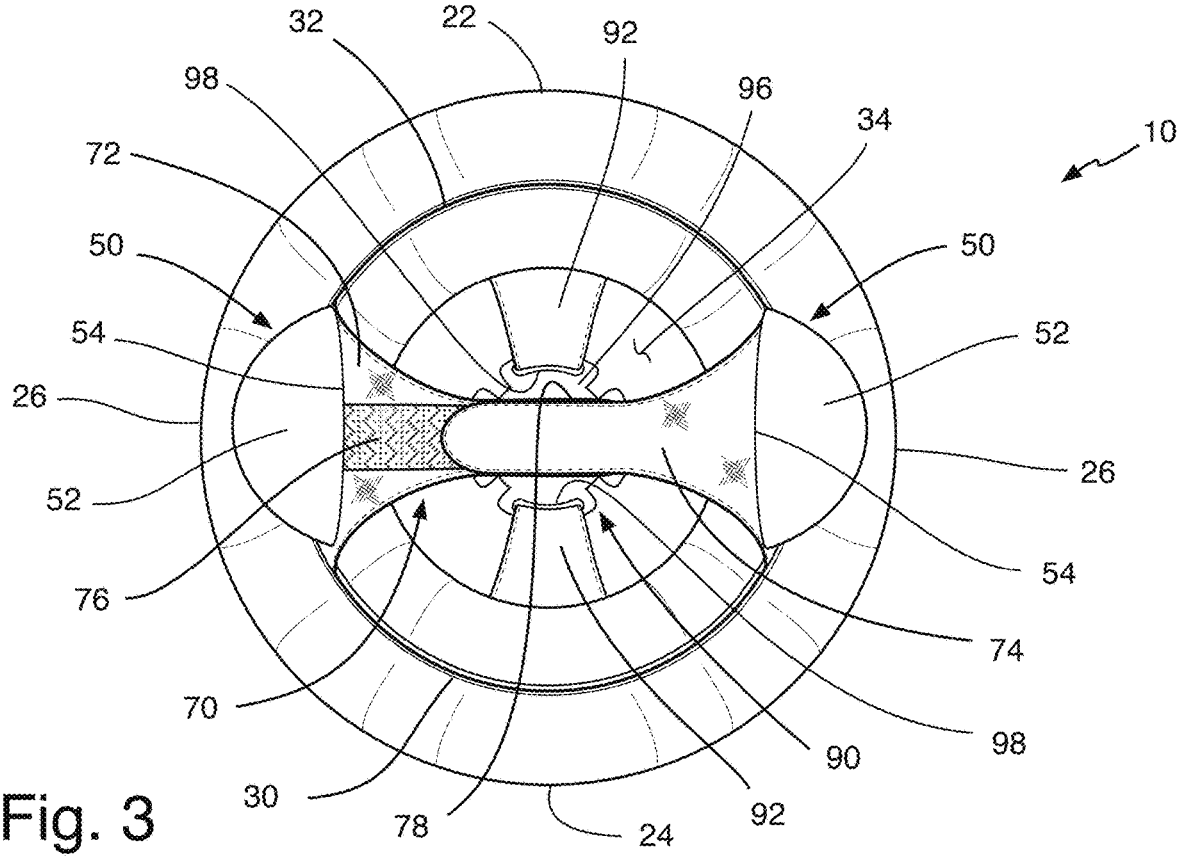
FIG. 3 is a bottom view of the present invention.
Figure 4:
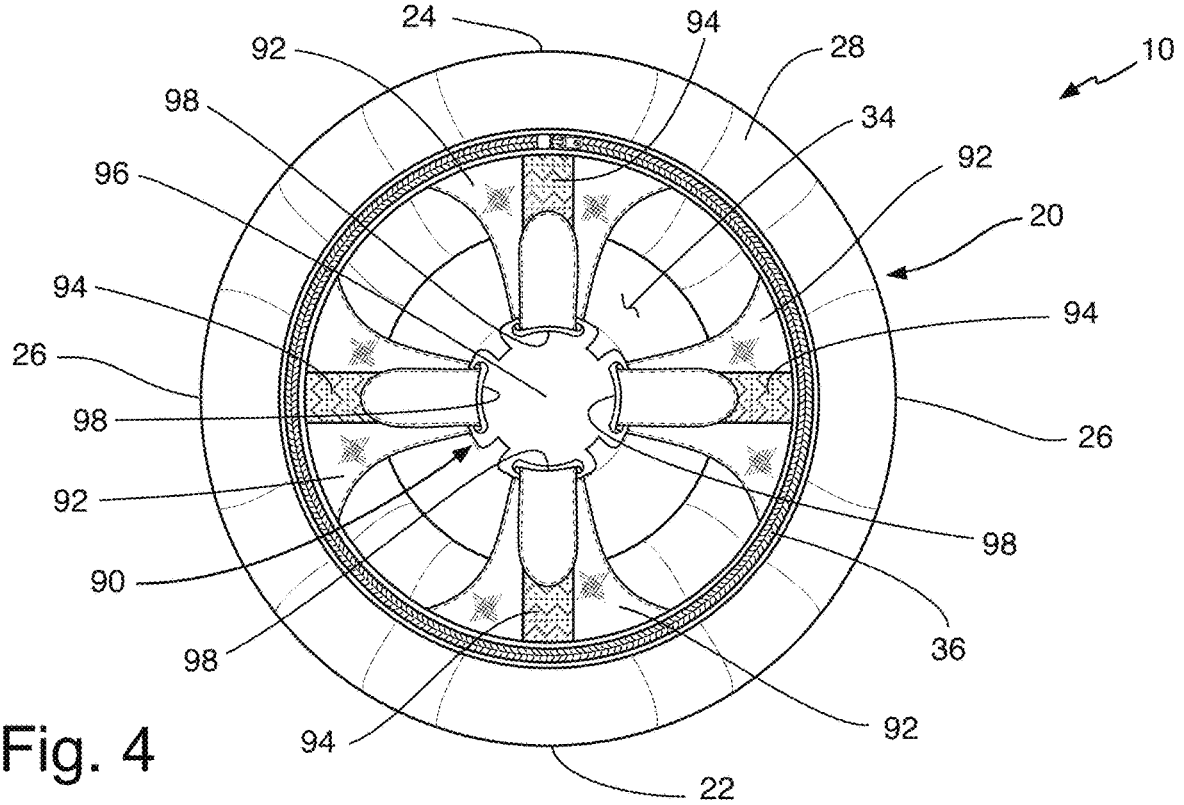
FIG. 4 is a top view of the present invention.

As seen in FIGS. 2 and 3, bottom strap assembly 70 comprises first and second straps 72 and 74 having respective fastener pieces 76 and 78. First and second straps 72 and 74 extend from a lower section of respective first and second earflap perimetral edges 54. A section of first and second straps 72 and 74 are further attached to first and second lateral panels 26 respectively. First and second straps 72 and 74 are joined under chin CH by fastener pieces 76 and 78. First and second straps 72 and 74 are adjusted with fastener pieces 76 and 78 to fit around head H, and specifically around the face of user U. In a preferred embodiment, fastener pieces 76 and 78 are two strips of a hook-and-loop fastener.

As seen in FIG. 4, top strap assembly 90 is attached to top end 28. Top strap assembly 90 comprises four straps 92 having respective fasteners 94, and crown support 96 having four slots 98. Straps 92 each extend from top end 28 toward cavity 34. The four straps 92 are positioned at top end 28 and are separated approximately 90 degrees from each other. Each slot 98 is aligned with its respective strap 92, whereby each slot 98 receives its respective strap 92. Each strap 92 engages with its corresponding slot 98, forming a loop secured by a respective fastener 94. In a preferred embodiment, fasteners 94 are hook-and-loop fasteners. Straps 92 and fasteners 94 allow to adjust the diameter of cavity 34.

Figure 5:
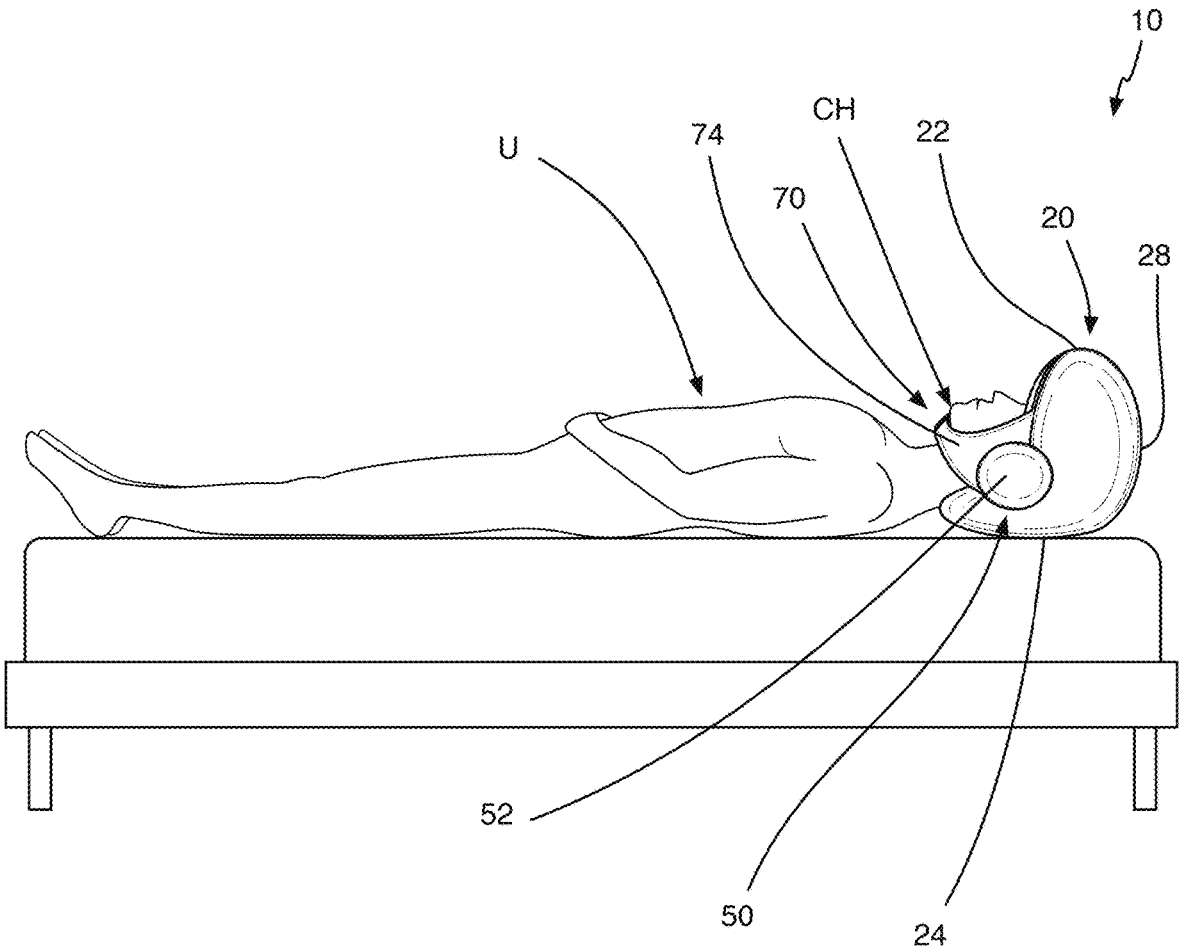
FIG. 5 is a view representing a person lying down while wearing the present invention.
Figure 6:
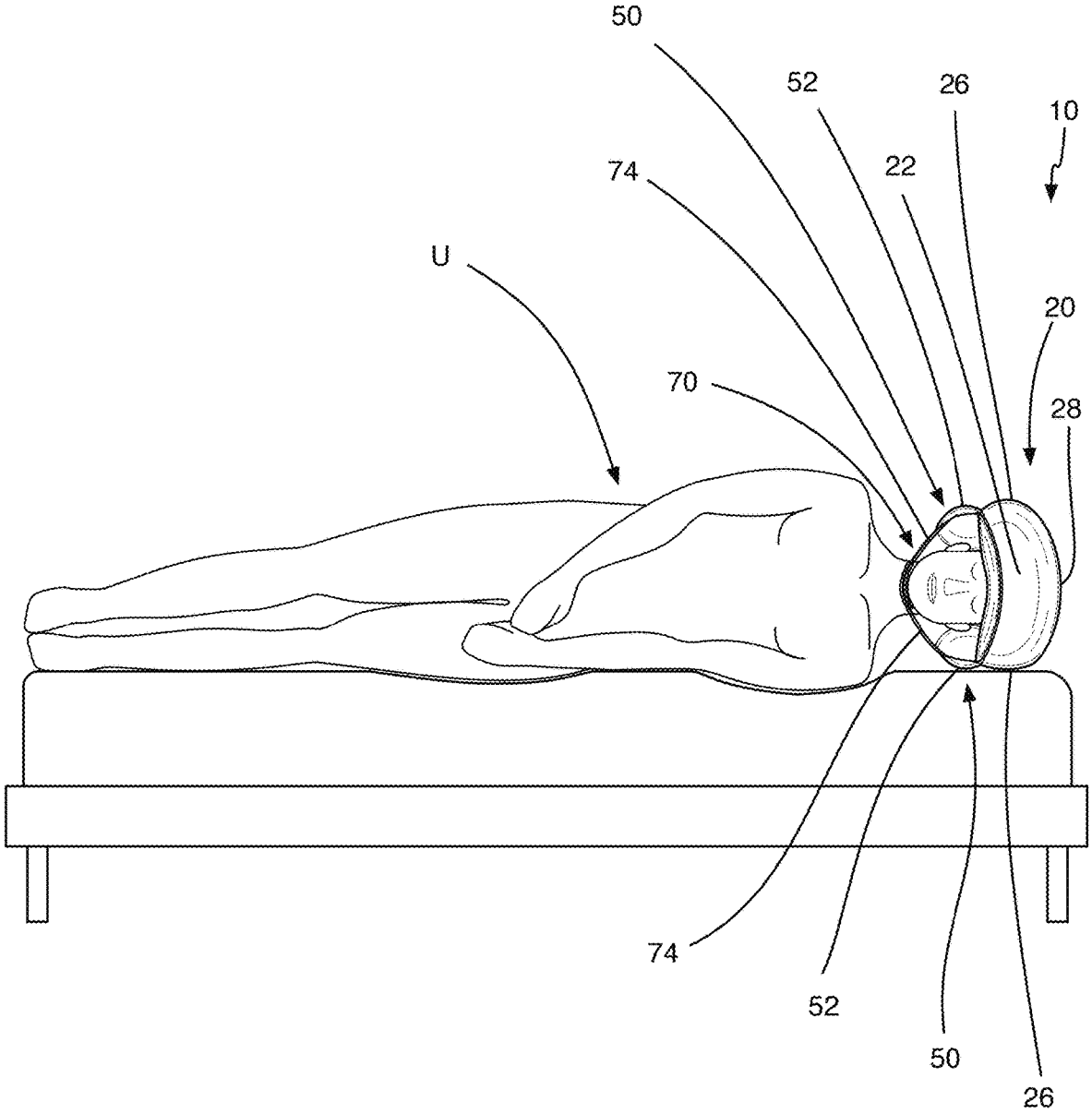
FIG. 6 is a view representing a person lying on their side while wearing the present invention.

As seen in FIGS. 5 and 6, present invention 10 is worn by user U. More specifically, present invention 10 is mounted onto head H of user U to rest and/or sleep. User U can adopt any desired position resting and/or sleeping including facing up, down, or to a side. In another embodiment, present invention 10 may be used as a conventional pillow, whereby user U may lay head H on pillow of present invention 10 without wearing it.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A pillow assembly, comprising:

A) a pillow body having a front panel, a rear panel, lateral panels, and a top end, said front panel, said rear panel, and said lateral panels define a cavity, said top end comprises a zipper in a circular formation, said front panel, said rear panel, and said lateral panels form a single piece, said pillow body is worn by a user;

B) earflaps attached to said pillow body, said pillow body further comprises a rear panel bottom end and a front panel bottom end, said earflaps comprise first and second earflaps having first and second perimetral edges respectively, said first and second earflaps are attached to said first and second lateral panels respectively;

C) a bottom strap assembly, comprising first and second straps having respective fastener pieces wherein said first and second straps extend from a lower section of respective first and second earflap perimetral edges, said first and second straps are joined under a chin by said fastener pieces, said fastener pieces adjust said first and second straps to fit around a head; and D) a top strap assembly attached to said top end, wherein said top strap assembly comprises four straps having respective fasteners, and a crown support having four slots, said straps extend from said top end toward said cavity, said four straps are positioned on said top end separated approximately 90 degrees from each other, each of said slots is aligned with a respective one of said four straps, whereby each said slot receives one of said four straps, each of said four straps engages with a corresponding said slot, forming a loop secured by respective said fasteners, said four straps adjust a diameter of said cavity, said pillow body is adjusted on said head by said top strap assembly and said bottom strap assembly.

* * * * *